US006875731B1

(12) United States Patent
Bence

(10) Patent No.: US 6,875,731 B1
(45) Date of Patent: Apr. 5, 2005

(54) THIXOTROPIC COMPOUNDS AND METHODS OF MANUFACTURE

(76) Inventor: Patrick Joseph Bence, 24 Deerbrook Road S.E., Calgary AB T2J 6L6 (CA)

( * ) Notice: Subject to any disclaimer, the term of this patent is extended or adjusted under 35 U.S.C. 154(b) by 252 days.

(21) Appl. No.: 10/382,115

(22) Filed: Mar. 4, 2003

(51) Int. Cl.[7] ..... C10M 159/24
(52) U.S. Cl. ..... 508/401; 508/391; 508/460
(58) Field of Search ..... 508/401, 402

(56) References Cited

U.S. PATENT DOCUMENTS 3,816,310 A 6/1974 Hunt
4,161,566 A 7/1979 Higgins
4,479,981 A 10/1984 Winters et al.
4,597,880 A 7/1986 Eliades
4,629,753 A 12/1986 Quinn
4,718,942 A * 1/1988 Laura et al. ..... 106/14.29
4,729,791 A * 3/1988 Laura et al. ..... 106/14.23
5,283,276 A * 2/1994 Best et al. ..... 524/166
5,308,514 A * 5/1994 Olson et al. ..... 508/155
5,338,467 A * 8/1994 Olson et al. ..... 508/186
5,407,471 A 4/1995 Rohr et al.
5,455,075 A * 10/1995 Longo ..... 427/398.1
5,534,169 A * 7/1996 Vinci ..... 508/460
5,780,398 A * 7/1998 King et al. ..... 508/401

FOREIGN PATENT DOCUMENTS

CA 2057196 12/1991

* cited by examiner

*Primary Examiner*—Ellen M McAvoy
(74) *Attorney, Agent, or Firm*—Hicks & Penman Ltd.; Andrew R. Hicks

(57) ABSTRACT

The invention relates to thixotropic compositions and methods of manufacture. The compositions are prepared from fatty acids and sulfonic acids mixed with a stoichiometrically equivalent amount of calcium hydroxide. Oils, calcium carbonate and water are also added to create viscous, grease-like materials that are particularly useful for undercoating applications as well as corrosion inhibiting film coatings.

26 Claims, No Drawings

THIXOTROPIC COMPOUNDS AND METHODS OF MANUFACTURE

BACKGROUND OF THE INVENTION

Thixotropic compositions are useful as coatings in many applications including the automotive industry where they are used as undercoating materials and interior cavity protective films.

A composition having thixotropic properties has a reduced viscosity under high shear conditions and a higher viscosity under low shear conditions. These properties are particularly useful in applications where it is desired to apply a normally viscous composition to surfaces using spraying equipment that, after spraying, results in adherence of the compositions to the surfaces. In the particular application of an undercoating material, in order to be effective as an undercoating material, the compositions should have spray properties enabling uniform spraying and atomization properties. In addition, other physical properties should provide appropriate properties of adhesion, cure time, sag (resistance to flow on vertical surfaces), heat-stability (sag at elevated temperature), film continuity as well as anti-corrosion and sound deadening properties.

Many coating compositions have been developed in the past and the market is well supplied with different products, many of which have unique properties and chemistries. As a result, there are a large class of compositions that provide some or many of the above properties.

From an economic or commercial perspective, there continues to be a need for thixotropic compositions that provide improvements in the above properties and that are economic to manufacture. That is, with the cost of raw materials and manufacturing processes affecting the cost to the consumer, there continues to be a need for protective coating compositions that remain competitive within the marketplace. In particular, there is a need for thixotropic compositions that are produced by a simplified and reliable process using readily available, economical and non-hazardous raw materials with simplified equipment and production times.

A review of the prior art indicates that in the past, many thixotropic compositions have been prepared by methodologies that result in various forms of calcium carbonate/calcium sulfonate mixtures having properties that impart corrosion resistance to metal surfaces. However, in many of these past processes, the use of other ingredients, such as promoters, have been required to achieve various chemical reactions, impart specific physical properties and/or to enable the creation of a stable colloidal suspension. Generally, surfactant materials (ie. oil soluble long-chain carboxylate salts and/or sulfonate salts) are required to make non-polar oil-like materials more compatible with polar inorganic salts ($Ca(OH)_2$ and $CaCO_3$) to enable the creation of a colloidal suspension of oils and the salt complexes.

Some of these past processes substitute all or part of the calcium sulfonate with calcium salts of various types of carboxylic acids. For example, U.S. Pat. No. 4,597,880 describes thixotropic compositions including short-chain water-soluble carboxylic acids that function as promoters to achieve needed chemical reactions and/or physical processes to enable calcium carbonate to be distributed as a colloidal suspension in oil-like carrier materials in a form which is sufficiently finely divided so as not to settle out.

Importantly, the advantages of eliminating promoter materials include:

a. The cost of using a material which has no functionality in the final product is eliminated;

b. The promoter materials are generally low flash organic materials (eg. alcohols) which require plant equipment for containment, ventilation etc. for safety and environmental reasons; and, c. There is evidence that these promoters interfere with the subsequent stage of producing the thixotropic materials, which is transforming the colloidal suspension into a gelled material. As a result, several processes may be required to strip the promoter materials out before proceeding to the next stage.

Moreover, past thixotropic compositions all disclose the use of sulfonic acids having a minimum aliphatic carbon chain length of 12 carbon atoms that are less reactive and are more expensive.

Further still, past processes have been made complex through manufacturing processes requiring the formation of $CaCO_3$ "in situ" by reaction of excess $Ca(OH)_2$ with $CO_2$ gas in order to obtain the necessary finely divided, and completely dispersed calcium carbonate particles that enable a colloidal dispersion. Thus, there has been a need for a process utilizing the addition of solid $CaCO_3$ that provides the desired physical/chemical results as well as the economic advantages of utilizing a single-step mixing process as opposed to a multiple-step chemical process.

As an example, Canadian Patent 2,057,196 describes longer chain (C8–C24) carboxylic acids in combination with oil soluble sulfonic acids neutralized to calcium salts with excess calcium hydroxide. In this patent, a calcium carbonate complex is produced by reaction of excess calcium oxide (or calcium hydroxide) with carbon dioxide gas introduced to the reaction mixture. This process has been described as necessary to obtain the calcium carbonate in the appropriately finely divided crystalline form. Furthermore, in this process, an alcohol "reaction promoter" is also utilized to form an initial "oil soluble dispersing agent".

Other prior art patents include U.S. Pat. No. 3,816,310 which discloses a method for preparing a rust inhibiting composition that contains oil soluble metal salts of sulfonic acids, carboxylic acids, and phosphorous sulfide treated olefins; U.S. Pat. No. 4,597,880 which discloses a one-step process for preparing a thixotropic calcium sulfonate complex containing calcium carbonate with calcium sulfonate being a dispersing agent; U.S. Pat. No. 5,407,471 which discloses a process for inhibiting the corrosion of metal by applying a coating containing an organic acid and at least one metal containing corrosion inhibitor; U.S. Pat. No. 4,161,566 which discloses the formation of an aqueous dispersion composition of irreversibly formed films by reacting a carboxylic acid with an overbased salt; U.S. Pat. No. 4,629,753 which discloses a water dispersed rust inhibiting composition comprising a film forming organic polymer and a non-Newtonian dispersion system comprising colloidal particles, a dispersing medium and a hydrophobic organic compound; U.S. Pat. No. 4,479,981 which discloses a thixotropic water reducible corrosion resistant coating containing carboxylic acid, an overbased sulfonate and an alcoholic coupling solvent such as propyl glycol ether and water.

SUMMARY OF THE INVENTION

In accordance with the invention, there is provided a method of preparing a thixotropic composition comprising the steps of:

a) mixing a major proportion of a carboxylic acid with a minor proportion of a sulfonic acid and a stoichiometrically equivalent amount of calcium hydroxide relative to the carboxylic acid and sulfonic acid with an oil diluent and heating the mixture to form a salt/diluent complex and reaction water;

b) removing the reaction water and cooling the salt/diluent complex;

c) adding additional oil diluent to reduce the viscosity of the salt/diluent complex;

d) adding calcium carbonate to form an overbased complex; and e) cooling the overbased complex and adding water to the mixture to produce a thixotropic composition.

In various embodiments of the method the carboxylic acid is a C14–C20 aliphatic carboxylic acid, the carboxylic acid is a tall oil fatty acid, the sulfonic acid is a C10–C18 aliphatic sulfonic acid, and/or the sulfonic acid is an alkyl aryl sulfonic acid wherein the alkyl group is C8–C14.

In other embodiments, the sulfonic acid is 5–15% wt % of the total acid content and/or the oil diluent in step a) is 10–35 wt % of the carboxylic acid and sulfonic acid.

In another embodiment, the method further comprises the step of blending the thixotropic compound with asphalt or waxes.

The invention also provides thixotropic compositions prepared in accordance with the method including a thixotropic composition comprising 30–56 wt % diluent, 10–30 wt % carboxylic acids, 1–6 wt % sulfonic acids, 1–6 wt % calcium hydroxide, 5–30 wt % calcium carbonate, 5–20 wt % water and, 0–2 wt % sodium hydroxide. The invention also specifically provides a thixotropic composition comprising 36 wt % diluent, 26 wt % carboxylic acids, 3 wt % sulfonic acids, 4 wt % calcium hydroxide, 19 wt % calcium carbonate and, 12 wt % water as well as a thixotropic composition wherein the carboxylic acid is 26 wt % tall oil fatty acid and the sulfonic acid is 3 wt % dodecyl benzene sulfonic acid.

DETAILED DESCRIPTION OF THE INVENTION

Thixotropic compositions and methods of making these compositions are herein described.

The thixotropic compositions in accordance with the invention comprise complexes formed by calcium salts of long chain carboxylic acids (fatty acids or other long chain fatty acids) and relatively shorter-chain sulfonic acids together with oil diluent to disperse calcium carbonate within a colloidal suspension. The calcium salts are formed from a mixture of the long chain fatty acids (for example, C14–C20), the shorter-chain sulfonic acids (for example, C8–C14 alkyl aryl sulfonic acid) and calcium hydroxide. The resulting compositions are particularly useful as anticorrosive compositions for protecting surfaces from rust and other damage.

In accordance with the invention, a blend of a major proportion of carboxylic acids and a minor proportion of sulfonic acids (preferably alkylbenzene sulfonic acids) and oil diluent are mixed together in a reaction vessel. A stoichiometric equivalent amount of lime (calcium hydroxide), relative to the total number of moles of the acids, is added to the mixture to neutralize the acids and to form a salt complex of the carboxylic acid/sulfonic acid in an exothermic reaction with water as a product of the reaction. During the reaction, the water boils off to produce a viscous mixture.

The mixture is then cooled and diluted with additional oil diluent to form a lower-viscosity mixture containing dispersed oil diluent.

Calcium carbonate is added to the mixture to combine with the salt complex to form an overbased complex wherein the calcium carbonate is either dispersed within the mixture as a fine dispersion or is solubilized within the mixture.

The mixture is further cooled and then mixed with a sufficient quantity of either water or dilute caustic soda (sodium hydroxide) to form a grease-like composition. If water is added in the final step, conversion to a semi-solid grease takes place slowly as the material cools to room temperature, allowing the material to be pumped easily from the reaction vessel to a storage container where solidification occurs. If caustic soda is added, conversion to semi-solid grease takes place rapidly. Additional caustic soda in solution may also be added after crystallization to provide improved heat stability to subsequent formulated products.

It is preferred that the compositions are prepared with 5–15% sulfonic acid to 85–95% carboxylic acid by weight.

Sulfonic Acids

Sulfonic Acids can be selected from sulfonic acids having an average aliphatic chain length of 10 or more or linear alkyl benzene sulfonic acids with aliphatic carbon chain lengths of 8–14 carbon atoms. A preferred sulfonic acid is dodecyl benzene sulfonic acid such as BIOSOFT S-100 (Stepan Chemical, Northfield Ill.). It is also preferred that greater than 90% of the sulfonic acids have chain lengths in the range of C8–C12.

Carboxylic Acids

Carboxylic acids can be selected from carboxylic acids having an aliphatic chain length of 14 carbon atoms or greater. "Tall oil" fatty acids are particularly effective such as TOFA 4 (18-Carbon-Mono- and Diunsaturated fatty acids) from Hercules Chemical (Mississauga, Ontario).

Lime

Fine powder lime such as CODEX HYDRATED LIME (Mississippi Lime Company) is preferred. In particular, fine lime powder having a particle size distribution of 99.9% smaller than 100 mesh, 99.0% smaller than 200 mesh and 96.5% smaller than 325 mesh is preferred.

Oil Diluents

The oil diluents can be selected from any aliphatic or aromatic hydrocarbon solvent or oil that is inert with respect to the overall reaction and can be selected from those as known to those skilled in the art.

In particular, mineral oil and mineral spirits are effective in the process and compositions.

Calcium Carbonate

Fine-ground calcium carbonate such as 3HX calcium carbonate from Imasco Minerals Inc. is preferred.

Water and/or Caustic Soda Addition

As noted above, in the final step of the process, a quantity of either water or dilute sodium hydroxide is added to the mixture under agitation while cooling is taking place and preferably between approximately 20–65° C. If sodium hydroxide is used, the sodium hydroxide concentration in water is approximately 5–15% (by weight) and preferably 12% (by weight). Addition of the dilute caustic soda solution instead of pure water results in a more rapid crystallization and thickening to a grease. Treatment of the thickened composition with additional caustic soda after crystallization (thickening) is preferred to optimize the heat stability properties of the composition at temperatures above 45° C.

EXAMPLES

Example 1

18.4 liters of mineral spirits diluent were mixed with 50.5 kg of tall oil fatty acids and 5.8 kg of C10 alkyl benzene sulfonic acid in a 200 liter stainless steel mixing vessel equipped with a water jacket for heating and cooling and a ½ hp mixer having 37 inch propeller-type agitator blades. The mixture was heated to 80–100° C. with moderate agitation. 7.25 kg of fine calcium hydroxide powder (96%+ smaller than 325 mesh) was sifted into the mixture with agitation causing an exothermic reaction as the calcium hydroxide reacted with the acids resulting in a viscous, dark brown homogenous fluid. Water formed by the reaction was allowed to boil off.

When the boiling ceased, the mixture was allowed to cool while maintaining agitation and a further 71.1 liters of mineral spirits diluent was added slowly to the mixture.

When the diluent addition was completed and the mixture had cooled to 70° C., fine particle size calcium carbonate was slowly sifted in the mixture under agitation to form a tan colored, moderately viscous fluid.

Mixing was maintained for approximately 60 minutes as the mixture continued cooling to 62° C. No accelerated cooling was done.

At 62° C., 22.9 liters of water was added and mixing continued for a further 30 minutes whereupon the mixture was pumped to a storage vessel to cool to room temperature.

When cooled and solidified, the final material was a brown, firm grease-type material.

Example 2

Example 1 was repeated with the difference that the mixture was cooled further before water addition. In this example, during cooling and at approximately 52° C., 22.9 liters of cold water (at ambient temperature) were added. Mixing was continued for a further 15 minutes and the mixture was then pumped to a storage vessel and allowed to cool to room temperature.

When cooled and solidified, the final material was a brown, soft, grease-type material.

Example 3

356 g of tall oil fatty acid and 40 g of CIO alkyl benzene sulfonic acid and 100 g of mineral spirits diluent were mixed in a 2 liter stainless steel flask. The flask was heated to 90° C. in a hot water bath.

51 g of calcium hydroxide were slowly added with agitation and the temperature of the mixture rose to 100° C. with evolution of water vapor. Mixing was continued for 15 minutes until the water boiling ceased. The mixture was a viscous, dark brown homogenous liquid.

386 g of mineral spirits diluent was added to the mixture with agitation and the vessel was placed in a cold-water bath to cool. At 42° C., 255 g of calcium carbonate was added while cooling and mixing was continued for 30 minutes. The temperature after cooling was 26° C.

5.4 g of caustic beads were dissolved in 161 g of water and added to the mixture with mixing. Mixing continued for 20 minutes and the mixture was removed from the water bath to complete cooling to room temperature.

After 48 hours, the product was very soft, deformable light brown grease.

Product Performance

Additional compounding of the products into different protective coating products tested the performance of the grease products. These included asphaltic-based coating products that are useful for underbody coatings and wax-based coating products that are useful for interior cavity rust protection.

Asphaltic-Based Coating Products

Grease prepared in accordance with example 2 was mixed with asphalt, an inorganic mineral drying agent/filler, a solvent and caustic soda solution in proportions of standard undercoating formulations to produce an asphaltic product.

The asphaltic product was subjected to performance tests including sag tests and spray tests described as follows:

Sag Test

⅛" (3.2 mm) of the asphaltic product was deposited onto a steel plate. The sample plate was suspended vertically and heated via a heat lamp. The temperature of the plate was recorded to observe the temperature at which the product began to sag or run down the metal surface. Samples exhibited no sag behavior up to at least 70° C.

Spray Test

The asphaltic product was sprayed through commercial spray equipment utilizing a standard equipment setup (nozzle tip size, pump pressure, product temperature). Qualitative evaluations were made based on spray characteristics such as ease of atomization, and amount of overspray or misting. This provided a practical means of measuring the amount of thixotropy exhibited by the various grease products.

Wax-Based Coating Product

Grease prepared in accordance with example 2 was mixed with a microcrystalline wax, a diluent and a caustic soda solution in proportions of standard interior cavity formulations to produce a wax-based product.

Sag Test

A sag test as above was performed with similar results.

Spray Test

Spray tests using commercial rust proofing spray equipment were conducted by spraying the wax-based product on flat metal panels. Qualitative evaluations of film continuity and spray characteristics were acceptable.

Corrosion Resistance Test

Both asphaltic- and wax-based samples were also evaluated for corrosion resistance by spray coating ½ the surface of a 3"×5" cold rolled steel plates with each product. The plates were then sprayed with 5% salt solution at periodic intervals and the development of rust observed on the coated and uncoated portions of the plates. Other samples were submitted to an independent laboratory for testing according to the ASTM B-117 salt fog test. The asphaltic- and wax-based products were compared to materials from competitive products treated in the same way. The results indicated that the products provided acceptable properties to the comparable, competitive products.

Discussion

The invention shows that the use of relatively shorter chain sulfonic acids together with longer chain carboxylic acids without the use of promoters enables the synthesis of thixotropic compositions having suitable end use properties. While the shorter chain sulfonic acid does not provide good suspension properties by itself, it does provide good reactivity, which in combination with the longer chain carboxylic acids, makes for stable colloidal suspensions, and when gelled gives excellent thixotropic properties.

In addition, the invention demonstrates that the production of thixotropic compositions having improved temperature stability is achieved with the addition of a caustic soda solution after the gelling or crystallization step.

Further, the methodology and compositions prepared in accordance with the invention, provide economic and technical advantages over past processes particularly as carboxylic acids are less expensive than sulfonic acids and further permits the use of types of sulfonic acids that are more widely available and more economic than those used in previous processes.

In addition, it has been discovered that the cooling rate and temperature at which the water is added are variables that can be used to provide control of the final consistency of the thickened composition, ranging from soft to firm grease. More specifically, conditions that promote rapid crystallization of calcium carbonate give rise to soft greases. Such conditions include either: a) a lower mix temperature when water comes into intimate contact with the mixture; b) longer mixing times after water addition; and/or, c) a more vigorous mixing of water into the mixture.

For example, for the creation of soft grease, room temperature calcium carbonate was added to the mixture at approximately 70° C. (this resulted in a mixture temperature of approximately 60–65° C.). The mixture was cooled to approximately 56° C. with a water jacket and room temperature water was added and mixed for approximately 1 hour to give a final mixture temperature of 40–46° C. before pumping to storage. After 24 hours, the mixture was soft grease.

In comparison, firm grease was created by adding room temperature water to the mixture (containing calcium carbonate) at a higher temperature (60–65° C.) followed by 30 minutes of mixing prior to pumping to storage. After 24 hours, the mixture was firm grease.

Very soft grease was prepared in accordance with the process for preparing the soft and firm greases but with cooling of the mixture (containing calcium carbonate) to a lower temperature of 45° C. Addition of room temperature water at 40–45° C. and a shorter mixing time (approximately 15 minutes) resulted in a final mixture temperature of approximately 33° C. prior to pumping to storage. After 24 hours, the mixture was very soft grease.

While the above descriptions generally refer to soft, firm and very soft greases and the temperatures of water addition that promote the formation of such greases, it is understood that a range of consistencies of greases can be created within the disclosed temperature ranges and in accordance with the invention.

What is claimed is:

1. A method of preparing a thixotropic composition comprising the steps of:

a. mixing a major proportion of a carboxylic acid with a minor proportion of a sulfonic acid and a stoichiometrically equivalent amount of calcium hydroxide relative to the carboxylic acid and sulfonic acid with an oil diluent and heating the mixture to form a salt/diluent complex and reaction water;

b. removing the reaction water and cooling the salt/diluent complex;

c. adding additional oil diluent to reduce the viscosity of the salt/diluent complex;

d. adding calcium carbonate to form an overbased complex; and e. cooling the overbased complex and adding water to the mixture to produce a thixotropic composition.

2. A method as in claim 1 wherein the carboxylic acid is a C14–C20 aliphatic carboxylic acid.

3. A method as in claim 1 wherein the carboxylic acid is a tall oil fatty acid.

4. A method as in claim 1 wherein the sulfonic acid is a C10–-C18 aliphatic sulfonic acid.

5. A method as in claim 1 wherein the sulfonic acid is an alkyl aryl sulfonic acid wherein the alkyl group is C8–C14.

6. A method as in claim 1 wherein the sulfonic acid is 5–15% wt % of the total acid content.

7. A method as in claim 1 wherein the oil diluent in step a) is 10–35 wt % of the carboxylic acid and sulfonic acid.

8. A method as in claim 1 wherein the oil diluent is selected from any one of or a combination of mineral spirits, mineral oil or Stoddard solvent.

9. A method as in claim 1 wherein the solvent is a mineral oil.

10. A method as in claim 1 wherein the calcium hydroxide has a particle size distribution of 99.9% smaller than 100 mesh.

11. A method as in claim 1 wherein the calcium hydroxide has a particle size distribution of 99.0% smaller than 200 mesh.

12. A method as in claim 1 wherein the calcium hydroxide has a particle size distribution of 96.5% smaller than 325 mesh.

13. A method as in claim 1 wherein the calcium carbonate is a powder.

14. A method as in claim 1 wherein step e) is cooling the overbased complex and adding a dilute sodium hydroxide in water solution to the mixture to produce a thixotropic composition.

15. A method as in claim 1 further comprising the step of adding a dilute sodium hydroxide in water solution to the thixotropic composition.

16. A method as in claim 14 wherein the dilute sodium hydroxide solution is 5–15 wt % sodium hydroxide in water.

17. A method as in claim 1 wherein in step b) the mixture is cooled to 70° C.

18. A method as in claim 1 wherein in step e) the mixture is cooled to 25–65° C. prior to the addition of water.

19. A method as in claim 1 wherein in step e) the mixture is cooled to 40–45° C. prior to the addition of water.

20. A method as in claim 1 wherein in step e) the mixture is cooled to 50–56° C. prior to the addition of water.

21. A method as in claim 1 wherein in step e) the mixture is cooled to 60–65° C. prior to the addition of water.

22. A method as in claim 1 further comprising the step of blending the thixotropic compound with asphalt or waxes.

23. A thixotropic composition prepared in accordance with the method of claim 1.

24. A thixotropic composition comprising:

a. 30–56 wt % diluent;

b. 10–30 wt % carboxylic acids;

c. 1–6 wt % sulfonic acids;

d. 1–6 wt % calcium hydroxide;

e. 5–30 wt % calcium carbonate;

f. 12 wt % water; and, g. 0–2 wt % sodium hydroxide.

25. A thixotropic composition as in claim 24 comprising:

a. 36 wt % diluent;

b. 26 wt % carboxylic acids;

c. 3 wt % sulfonic acids;

d. 4 wt % calcium hydroxide;

e. 19 wt % calcium carbonate; and, f. 12 wt % water.

26. A thixotropic composition as in claim 24 wherein the carboxylic acid is 26 wt % tall oil fatty acid and the sulfonic acid is 3 wt % dodecyl benzene sulfonic acid.

* * * * *